US005081471A

United States Patent [19]

Thomas

[11] Patent Number: 5,081,471

[45] Date of Patent: Jan. 14, 1992

[54] TRUE EDGE THERMAL PRINTHEAD

[75] Inventor: Lowell E. Thomas, Tewksbury, Mass.

[73] Assignee: Dynamics Research Corporation, Wilmington, Mass.

[21] Appl. No.: 584,188

[22] Filed: Sep. 18, 1990

[51] Int. Cl.[5] ..... B41J 2/335

[52] U.S. Cl. ..... 346/76 PH; 219/543

[58] Field of Search ..... 346/76 PH; 219/543

[56] References Cited

U.S. PATENT DOCUMENTS

| | | | |
|---|---|---|---|
| 4,232,213 | 11/1980 | Taguchi et al. | 219/216 |
| 4,636,811 | 1/1987 | Bakewell | 346/76 PH |
| 4,651,168 | 3/1987 | Terajima et al. | 346/76 PH |
| 4,705,697 | 11/1987 | Nishiguchi et al. | 427/36 |
| 4,810,852 | 3/1989 | Bakewell | 219/216 |

*Primary Examiner*—Benjamin R. Fuller
*Assistant Examiner*—Huan H. Tran
*Attorney, Agent, or Firm*—Weingarten, Schurgin, Gagnebin & Hayes

[57] ABSTRACT

A true edge thermal printhead and method of fabrication wherein the printhead infrastructure is formed by thick film techniques and the individual laminations are formed in a predetermined order. The printhead infrastructure includes a dielectric substrate, a common electrode layer, a high temperature glaze, an electrode pattern, a low temperature glaze and a plurality of resistive heating elements formed on the edge of the infrastructure and interconnected to the electrode pattern and the common electrode layer. The common electrode layer is a unitary sheet of refractory conductive material that is compatible with the high firing temperatures required for the high temperature glaze, and includes multiple ground taps. The fine image electrode pattern is compatible with the reduced firing temperature of the low temperature glaze such that gold pastes may be efficaciously utilized in the formation of the electrode pattern. Driver chips for activating the resistive heating elements are mounted in the printhead infrastructure to enhance printhead performance. Thermistors may be mounted on the glaze and/or substrate to monitor printhead temperature.

19 Claims, 3 Drawing Sheets

TRUE EDGE THERMAL PRINTHEAD

FIELD OF THE INVENTION

The present invention relates generally to thermal printing, and more particularly to a true edge thermal printhead and method of fabricating same.

BACKGROUND OF THE INVENTION

Thermal printheads of the true edge type are receiving increasing recognition as having advantages over other types of thermal printheads. Positioning resistive heating elements along an edge of a substrate results in a more efficacious printhead inasmuch as the edge may be more readily shaped than top or bottom planar surfaces. Further, the edge tends to be more rigid over longer lengths, thereby facilitating fabrication of longer printheads such as 24–36 inch plotter-type printheads.

The resistive heating elements of true edge thermal printheads can be brought more uniformly into contact with the thermally sensitive medium for higher quality printing. Lower force is required to maintain contact between the printhead and the medium such that ancillary printhead equipment may be simplified. Less surface area of the printhead comes into contact with the printing medium such that the printhead is subjected to less force.

Edge-type thermal printheads may be fabricated as laminated structures as generally illustrated in U.S. Pat. No. 4,651,168. As the name implies, the resistive heating elements are formed along one edge of the printhead infrastructure. The printhead infrastructure disclosed in the '168 patent includes a dielectric substrate, an electrode pattern laminated on the substrate to form conductive leads for the individual resistive heating elements, a glass layer formed from a glass baked onto the substrate and electrode pattern, a common electrode layer formed on the glass layer, and another glass layer overlaying the common electrode layer.

The high temperature glass layer forms a thermally resistive electrical insulation beneath resistive heating elements. This barrier retards the loss of the initial energy applied to the resistive heating elements so that the printing function may be accomplished. The glass layer also functions as a dissipation path to allow the excess thermal energy generated by the resistive heating elements to transfer to the substrate and printhead heat sinks.

The glass layer is generally formed from high softening point glasses as these have been found to give optimum results. The 168 patent describes the glass layer overlaying the electrode pattern as a high melting point glass that is baked upon the electrode pattern laminated on the substrate. One significant disadvantage of forming a thermal printhead as described in the '168 patent is the fact that the high temperature glass layer must be baked upon the electrode layer at temperatures that exceed the melting point of the electrode material.

The high firing/baking temperatures required to laminate the glass layer may adversely affect the underlying electrode pattern. Many modern printers have a heating element density of about 400 heating elements per inch. Prototype printheads having 800 heating elements per inch have been developed. These printheads require a fine image electrode patterns to provide the necessary conductive leads for the individual printing elements. Individual conductive traces of the pattern may be separated by a matter of microns and have thicknesses of only several microns. Such fine image electrode patterns, however, may be adversely affected by the high firing temperatures required to laminate a high softening point glass layer.

For example, one gold paste commonly used to form fine image electrode patterns has a baking temperature of about 850° C. If the firing temperature of the glass layer is above 1200° C. fluidization and consequent disruption of the fine image electrode pattern may result. Therefore, a need exists for a thermal printhead formed by a method wherein the electrode pattern is not subjected to excessive firing temperatures such that gold pastes may be utilized to form the fine image electrode pattern.

SUMMARY OF THE INVENTION

To overcome the inherent disadvantages of prior art thermal printheads, a true edge thermal printhead is described wherein the laminations comprising the printhead infrastructure are laid down in a predetermined order such that no deleterious effects are experienced due to the high firing temperatures required for the high temperature glaze layer. The printhead infrastructure comprises a dielectric substrate, a common electrode layer, a high temperature glaze, a thick-film electrode pattern laminated on the high temperature glaze, a low temperature glaze, resistive heating elements, and driver chips embedded in the infrastructure.

The common electrode layer is formed on the dielectric substrate by thick film techniques. The common electrode layer is formed from a conductive refractory material having a melting point substantially above the firing temperatures required by the high temperature glaze. Multiple ground taps may be run from the common electrode layer for electrical interconnection with respective driver chips to provide compensation for variations in density of the resistive heating elements.

A planarizing high temperature glaze material is applied onto the common electrode layer and fired at high temperatures to form the high temperature glaze. Inasmuch as the common electrode layer is formed from a conductive refractory material and does not require fine imaging, the common electrode layer is compatible with the high temperature glaze inasmuch as the high firing temperature does not adversely affect the structure of the common electrode layer. The high temperature glaze may be formed in such a manner as to include wells for mounting the driver chips, thermistors and/or other devices in combination with the infrastructure.

The electrode pattern is formed on the high temperature glaze by conventional thick film techniques. The electrode pattern includes end faces that interface with the resistive heating elements and integral conductive traces that electrically interface with respective driver chips. The end faces may be oversized in width as compared to the conductive traces to permit manufacturing tolerance in the formation of the resistive heating elements while ensuring complete electrical interconnection between the heating elements and the end faces of the electrode pattern. Inasmuch as the electrode pattern is formed as an overlay on the high temperature glaze, and consequently not subjected to the high firing temperatures necessary to form the high temperature glaze, gold pastes may be advantageously utilized to form the common electrode pattern.

The driver chips are mounted in combination on the printhead infrastructure and electrically interconnected with the conductive traces and the common electrode layer. The chips may be mounted in wells formed in the high temperature glaze layer or surface mounted on the glaze layer.

The low temperature glaze is overlayed upon the electrode pattern and fired to laminate the glaze thereto. The firing temperature of the low temperature glaze is of such magnitude that the fine image electrode pattern is not affected. The low temperature glaze functions as a protective and insulating layer for the fine image electrode pattern.

The edge surfaces of the common electrode layer and the high temperature glaze, the end faces of the electrode pattern, and the lower portion of the low temperature glaze define the infrastructure printing surface. The corresponding edge surfaces of the dielectric substrate and the upper portion of the low temperature glaze may be formed with a convex arcuate configuration to minimize the surface area subjected to contact with the printing medium.

To form printheads of extended length, two or more infrastructures as described in the preceding paragraphs are utilized to form the printhead. Individual infrastructures are lap and butt jointed together to form an extended printhead.

The resistive heating elements are deposited at true pitch on the printing surface of the printhead infrastructure. The resistive heating elements extend across the high temperature glaze and are interfaced with the common electrode layer and respective ones of the end faces of the fine image electrode pattern.

One or more thermistors may be mounted on the low temperature glaze and/or the high temperature glaze to monitor the temperature of the Printhead infrastructure. The thermistor(s) may be mounted in wells or surface mounted. The thermistor(s) may be mounted in the center of the infrastructure. For high speed printheads, the thermistor(s) are preferably mounted adjacent the resistive heating elements.

Cooling support blocks may be mounted on the dielectric substrate and the low temperature glaze to dissipate excessive thermal energy generated by the resistive heating elements from the printhead infrastructure. The cooling support blocks also act as mechanical support structures for the printhead.

BRIEF DESCRIPTION OF THE DRAWING

A more complete understanding of the present invention and the attendant advantages and features thereof will be more readily understood by reference to the following detailed description when considered in conjunction with the accompanying drawings wherein.

DETAILED DESCRIPTION OF PREFERRED EMBODIMENTS

Figure 1:
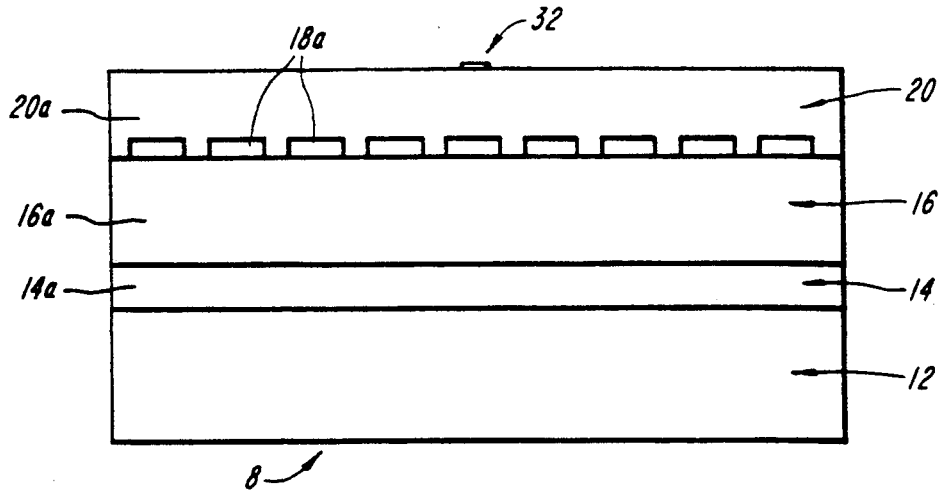
FIG. 1 is an end plan view of the infrastructure of a true edge printhead according to the present invention.
Figure 2:
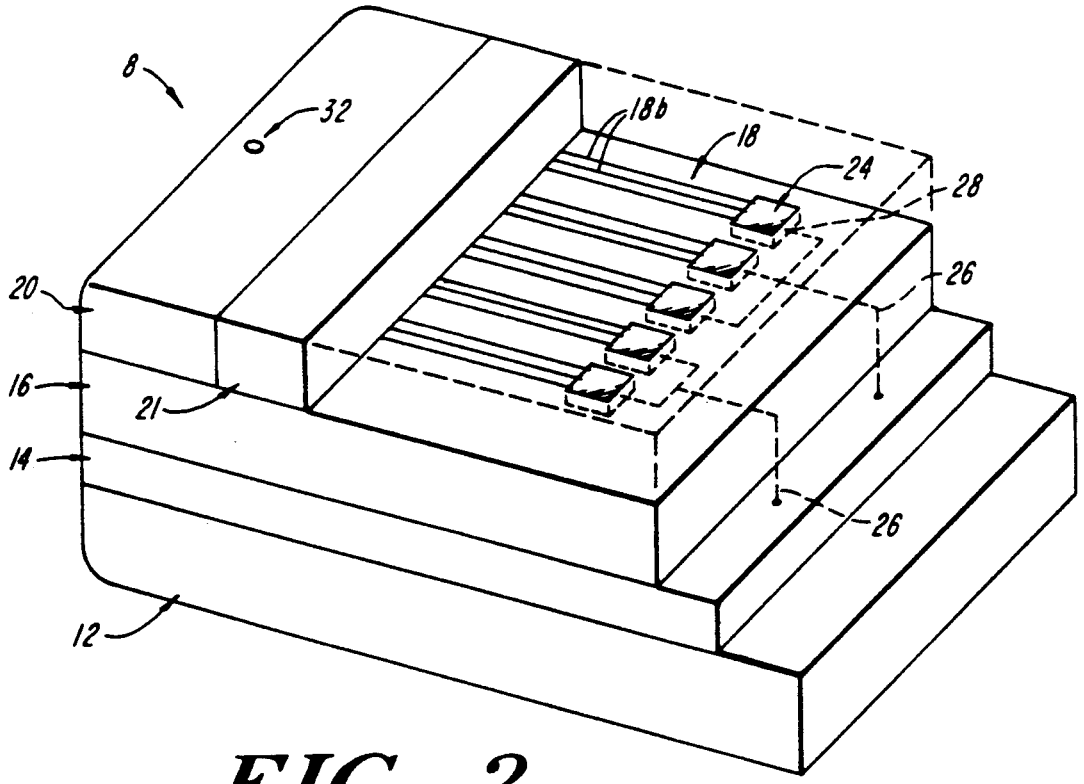
FIG. 2 is a sectioned, partial perspective view of the printhead infrastructure of FIG. 1.
Figure 3:
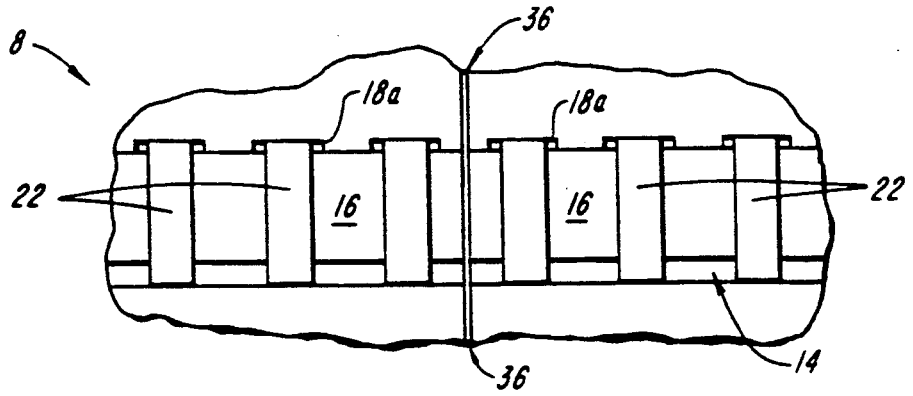
FIG. 3 is a partial end plan view of FIG. 1 illustrating the resistive heating elements formed thereon.

Referring now to the drawings wherein like reference numerals designate corresponding or similar elements throughout the several views, one exemplary embodiment of the infrastructure 8 of a true edge thermal printhead 10 formed by thick film techniques is illustrated in FIGS. 1 and 2. The printhead infrastructure 8 comprises a dielectric substrate 12, a common electrode layer 14, a high temperature glaze 16, a thick-film electrode pattern 18 laminated to the glaze 16, a low temperature glaze 20, resistive heating elements 22, and driver chips 24 embedded in the infrastructure 8 for selectively energizing the heating elements 22. Optionally, a thin high temperature glaze (FIG. 5, reference numeral 34) may be interposed between the substrate 12 and the common electrode layer 14.

Figure 5:
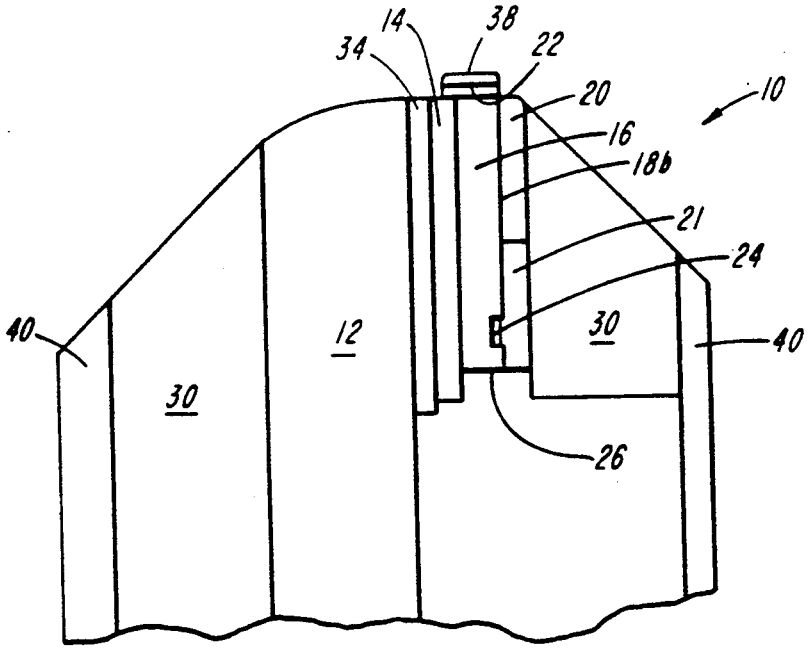
FIG. 5 is a partial cross-sectional view of a single row true edge thermal printhead according to the present invention.

The dielectric substrate 12 may be a ceramic type material such as alumina, $Al_2O_3$. Alternatively, the dielectric substrate 12 may comprise a metallic member that is coated with a dielectric material. The dielectric substrate 12 has a thickness in the range of about 0.6 mm to about 3 mm depending upon the printhead configuration. The edge surface of the substrate 12 adjacent the printing surface may have a convex arcuate configuration, as illustrated in FIGS. 2, 5, to better define the printing surface for the printhead 10.

One major surface of the dielectric substrate is prepared for subsequent lamination of layers thereto to ensure that the electrode pattern 18 lies in a common plane. The dielectric substrate 12 may be cast and ground to obtain a predetermined surface finish and flatness for subsequent laminations. In lieu of extensive grinding to obtain the required surface characteristics, a thin glaze of high temperature glass 34 (FIG. 5) may be laminated to the surface of the dielectric substrate 12 to provide the required surface finish and flatness.

A common electrode layer 14 is applied onto the dielectric substrate 12 (or the thin glaze) by thick-film techniques. The common electrode layer 14 functions as the common electrode for the resistive heating elements 22 of the printhead 10, as discussed in further detail hereinbelow. Due to the manner of applying the high temperature glaze 16, as discussed in further detail hereinbelow, a conductive metallic material having a relatively high melting point should be used for the common electrode layer 14.

Conductive refractory metals which can be fired in air and having a melting point above about 1300° C. may be used to form the common electrode 14. Cermet conductor materials such as ESL #5542 manufactured by Electro Science Labs, Inc. of Pennsylvania, have particular utility in forming the common electrode layer 14.

Multiple ground taps 26 may be run from the common electrode layer 14 for electrical interconnection with respective driver chips 24. A schematic representation of the multiple ground tap 26 scheme is represented in FIGS. 2 and 5. Multiple ground taps 26 avoid power drops along the length of the printhead 10 and compensate for differences in densities of the resistive heating elements 22. Multiple ground taps 26 are especially efficacious for longer length printheads 10 such as 24–36" printheads for plotters.

A planarizing high temperature glaze 16 is applied onto the common electrode layer 14 and fired at temperatures of about 1200°–1300° C. Inasmuch as the common electrode layer 14 is formed from a refractory material, and does not require fine imaging, the high temperature glaze 16 is compatible with the common electrode layer 14. The high firing temperatures required to laminate the glaze 16 onto the common electrode infralayer 14 do not adversely affect the common electrode layer 14. As noted above, the high firing temperatures required by the glaze 16 would adversely affect a conductive electrode pattern, and particularly one formed from a thick-film gold paste.

Suitable glaze materials are alkali and lead free vitreous compositions of silicon, calcium and barium oxides. Materials of this type are well know to those skilled in the art and include GS-31 by NTK Technical Ceramics, Nagoya, Japan and PLS 3146 or PLS 3143 by Nippon Electric Glass Co., Osaka, Japan. Preferably, the glaze material may be applied by print screening utilizing standard microcircuit printing equipment. The glaze material may be print screened onto the common electrode 14 in such manner as to provide suitable wells 28 for driver chips, thermistors and/or other elements as discussed in further detail hereinbelow.

The composition and thickness of the glaze 16 affects certain parameters of the printhead 10. The composition of the glaze 16 is controlled to achieve a predetermined thermal impedance to control heat dissipation from the resistive heating elements. Concomitantly, the glaze 16 must be able to withstand the high heat generated by the resistive heating elements 22. The thickness of the glaze 16 determines the length of the resistive heating elements 22, and in consequence, is the primary determinant of the average resistance, R, of the resistive heating elements 22. By varying the thickness of the glaze 16, the average resistance, R, of the heating elements 22 may be precisely controlled.

Preferably, in forming the printhead infrastructure 8 the glaze 16 is overapplied to form a layer having a thickness greater than desired. The glaze 16 may then be polished to a constant uniform thickness to achieve a predetermined average resistance for the heating elements 22.

The electrode pattern 18 may be formed on the high temperature glaze 16 by conventional thick film techniques. As used herein, the electrode pattern 18 consists of the individual end faces 18*a* that interface with respective resistive heating elements 22 and corresponding integral conductive traces 18*b* that electrically interconnect the faces 18*a* with corresponding driver chips 24. The electrode pattern 18 provides the means for selectively activating individual resistive heating elements 22 to form printed text. The driver chips 24 provide the power to activate the individual heating elements 22. The operation of the driver chips 24, in turn, are controlled by an off-printhead device. For convenience, the electrical connections between the driver chips 24 and the off-printhead device are not shown in FIG. 2.

One technique for providing the electrode pattern 18 involves the application of a conductive paste to the glaze 16 by print screening so as to form the fine image comprising the electrode pattern 18. The conductive paste pattern is allowed to dry, and then fired at a moderately high temperature (about 850° C.) to form the fine image electrode pattern 18. Subsequent to firing, the gold paste exhibits the properties of the metal, i.e., gold having the melting point of 1064° C.

Another lamination method involves a subtractive thick film technique wherein a conductive paste is overlayed on the high temperature 16 glaze and fired at a moderately high temperature. The overlayed fired conductive layer is then selectively etched, for example chemically, to form the fine image electrode pattern 18. Regardless of the thick film technique utilized to form the electrode pattern 18, the end faces 18*a* that interface with the resistive heating elements 22 should be oversized (in the width dimension), that is, the width of the end faces 18*a* will be slightly greater than the constant width conductive traces 18*b*. This permits some manufacturing tolerance in the formation of the resistive heating elements 22 while ensuring one hundred percent electrical interconnection between the heating elements 22 and the end faces 18*a* of the electrode pattern 18. Oversizing the end faces 18*a* of the electrode pattern 18 also permits some additional control to be exerted over the average resistance, R, of the resistive heating elements 22.

Because the fine image electrode pattern 18 is formed as an overlay on the high temperature glaze 16, the printhead infrastructure 8 of the present invention facilitates the use of gold pastes to form the conductive electrode pattern 18. Suitable gold pastes well known to those skilled in the art include JM 114G, JM 1202 and JM 1301 manufactured by Johnson Matthey Electronics of San Diego, CA. Prior art printheads cannot advantageously utilize gold pastes inasmuch as the high temperature glaze would be overlayed upon the electrode pattern, and the subsequent firing at temperatures in excess of about 850° C. (such as the typical 1200°-1300° C.) would adversely affect the delicate configuration of the electrode pattern.

A low temperature glaze 20 is overlayed upon the electrode pattern 18 in a manner similar to that used for the high temperature glaze 16 and fired to laminate the glaze thereto. The firing temperature for the low temperature glaze 20 is of such magnitude that the fine image electrode pattern 18 is not affected. The low temperature glaze 20 such as JM 300 series, by Johnson Matthey, San Diego, California, having a firing temperature of 890°-950° C., functions as a protective layer for the electrode pattern 18 as well as providing a dielectric medium that electrically isolates adjacent conductive traces 18*b* and end faces 18*a*. The low temperature glaze 20 may be formed to include one or more wells 28 for mounting one or more thermistors 32 in combination with the infrastructure 8. The end surface of the low temperature glaze 20 adjacent the printing surface may have a convex arcuate configuration, as illustrated in FIG. 2, to better define the printing surface for the printhead 10.

As noted above, the driver chips 2 are mounted on the printhead infrastructure 8 which enhances the operation of the printhead 10 by reducing the impedance effects of the electrode pattern 18. The driver chips 24 may be mounted in the wells 28 formed in the high temperature glaze 16 such that another low temperature glaze 21 effectively buries the driver chips 24 and the electrode pattern 18 in the printhead infrastructure. Alternatively, the driver chips 24 may be surface mounted on the high temperature glaze 16. In either embodiment, the low temperature glaze acts as a dielectric medium that electrically isolates adjacent driver chips 24.

To form plotter-type printheads of extended length, two or more printhead infrastructures 8 as described in the preceding paragraphs are utilized to form the printhead. The individual infrastructures 8 are lap and butt jointed together, as illustrated by reference numeral 36, to form an extended printhead.

The printing surface for the printhead 10 is defined by the edge surface 16*a* of the high temperature glaze 16, the edge surface 14*a* of the common electrode 14, the exposed end faces 18*a* of the electrode pattern 18 and the lower edge surface 20*a* of the low temperature glaze 20. While the edge surface of the substrate 12 and the upper edge surface of the low temperature glaze 20 may comprise part of the printing surface, it is preferable to form the edge surface of the substrate 12 to have a convex arcuate configuration, thereby reducing the overall area of the printing surface. It is also preferable to form the upper portion of the edge surface 20*a* to have a convex arcuate configuration to minimize unwanted contact with the printing surface.

The resistive heating elements 22 are deposited at true pitch on the printing surface of the printhead infrastructure 8 as described in the preceding paragraph using conventional techniques such as sputtering or evaporation. Conventional resistive materials such as tantalum nitride, $Ta_2N$, nichrome, NiCr, or alloys of silicon and high melting point metals such as tantalum, tungsten, zirconium, titanium, or molybdenum may be used to form the resistive heating elements. The film thickness of the resistive heating elements 22 is a determinant of the average resistance, R, of the hearing elements, and is typically about 500–3000 Angstroms.

Each resistive heating element 22 extends across the high temperature glaze 16 to interconnect a specific end face 18*a* to the common electrode 14, thereby completing a conductive circuit with a driver chip 24. The individual heating elements 22 may be formed by conventional techniques such as masking, sputter deposition, photolithography and ion beam etch. The heating elements 22 may have a rectangular (as illustrated), serpentine or other shapes.

After the resistive heating elements 22 have been formed on the edge of the printhead infrastructure 8, one or more protective/wear resistant layer(s) 38 may be deposited onto the edge. Suitable materials include silicon oxide, $SiO_2$, tantalum pentoxide, $Ta_2O_5$, silicon nitride, $Si_3N_4$, or silicon carbide, SiC.

During printhead operation, power is applied to selected resistive heating elements 22 for very short periods of time, on the order of about 0.5 to about 5 ms. The temperature of an activated heating element 22 will rapidly increase from ambient to about 300°–500° C. Only about 15–25% or the thermal energy generated by an activated heating element 22 is used to accomplish printing. The remainder of the thermal energy must be dissipated from the printhead 10.

Figure 4:
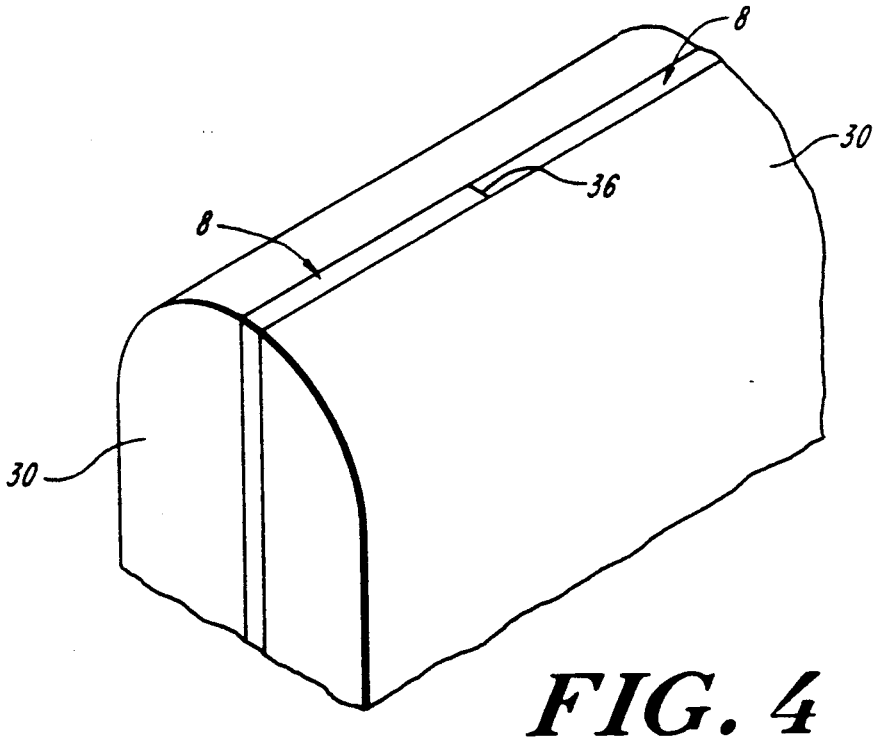
FIG. 4 is a partial perspective view of an extended printhead according to the present invention.

To transfer thermal energy away from the resistive heating elements 22, cooling support blocks 30 are mounted on the substrate 12 and the low temperature glaze 20 as illustrated in FIGS. 4 and 5. The cooling support blocks 30 may be formed from any material that is a good conductor of heat such as aluminum. The cooling support blocks 30 also act as mechanical support structures for the printhead 10. The cooling support blocks 30 are fabricated to have an arcuate configuration adjacent the printhead infrastructure 8 such that only the resistive heating elements 22 of the printhead 10 contact the printing paper.

One or more thermistors 32 may be mounted on the low temperature glaze 20 and/or the high temperature glaze 16 to monitor the temperature of the Printhead 10. The thermistor(s) 32 may be located at the center of the major surface of the low temperature glaze 20. For high speed printheads 10, it is Preferable to locate the thermistor(s) 32 adjacent the resistive heating elements 22. The thermistor(s) 32 may be mounted in well(s) 28 formed in the low or high temperature glazes 20, 16 as described above. Alternatively, the thermistor(s) 32 may be mounted on the upper major surface of the low temperature glaze 20. Suitable electric circuitry (not shown) interconnects the thermistor(s) 32 with appropriate monitoring circuitry. Cover plates 40 are affixed to the cooling blocks 30 to form the final printhead assembly.

Figure 6:
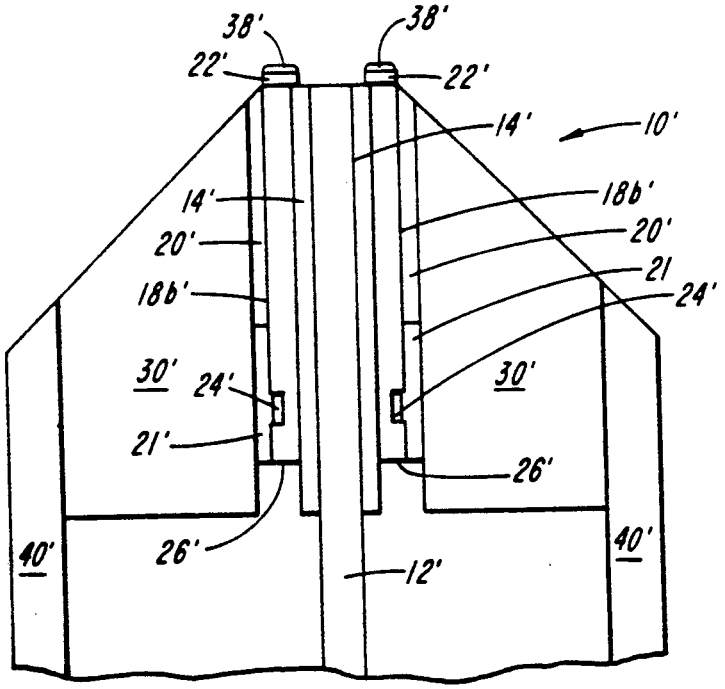
FIG. 6 is a partial cross-sectional view of a double row true edge thermal printhead according to the present invention.

The embodiments of the infrastructure 8 and printhead 10 as described in the preceding paragraphs comprise a single row true edge thermal printhead having a single row of resistive heating elements 22. A true edge thermal printhead 10' having a double row of resistive heating elements is illustrated in FIG. 6. The printhead 10' comprises two infrastructures as described in the preceding paragraphs, individual infrastructures being formed on each major surface of the dielectric substrate 12'.

A variety of modifications and variations of the present invention are possible in light of the above teachings. It is therefore to be understood that within the scope of the appended claims, the present invention may be practiced otherwise than as specifically described hereinabove.

What is claimed is:

1. An infrastructure for a true edge thermal printhead, comprising:

a substrate member having first and second major surfaces and an edge surface, at least one of said first and second major surfaces having a substantially flat planar surface;

a unitary common electrode layer formed from a refractory conductive material having a melting temperature above approximately 1300° C., laminated on said flat planar surface, one edge of said electrode layer being substantially coplanar with said edge surface of said substrate member;

a high temperature glaze laminated at approximately 1200–1300° C. on top of said common electrode layer and formed to have a predetermined thickness, one edge of said high temperature glaze being substantially coplanar with said one edge of said electrode layer;

an electrode pattern laminated on said high temperature glaze, said electrode pattern being formed of a conductive material comprising a metal having a melting point that exceeds a processing temperature of a subsequent laminated layer, and said electrode pattern being a fine image pattern including a plurality of end faces substantially coplanar with said one edge of said high temperature glaze and a plurality of conductive traces integrally connected to respective ones of said end faces and extending along said high temperature glaze away from said end faces and terminating in interface ends for electrical interconnection with driver chips;

a low temperature glaze laminated on said electrode pattern and said high temperature glaze, at a firing temperature less than the melting point of said metal of said electrode pattern, one edge of said low temperature glaze being substantially coplanar with said end faces of said electrode pattern;

said one edge of said common electrode layer, said one edge of said high temperature glaze, said end faces of said electrode pattern and at least a portion of said one edge of said low temperature glaze defining a printing edge surface for said infrastructure; and a plurality of resistive heating elements disposed on said printing edge surface of said infrastructure and interfaced, respectively, with said plurality of end faces and said common electrode layer.

2. The infrastructure of claim 1 further comprising a plurality of driver chips mounted in combination with said high temperature glaze distal said end faces of said electrode pattern, said driver chips being electrically connected to respective ones of said interface ends of said plurality of conductive traces and to a plurality of ground taps connected to said common electrode layer, and wherein said driver chips and said interface ends of said conductive traces are embedded within said infrastructure by a second or potting low temperature glaze.

3. The infrastructure of claim 2 wherein said high temperature glaze is formed to include a plurality of wells and wherein said plurality of driver chips are disposed in combination with said high temperature glaze by disposing said driver chips in respective ones of said plurality of wells.

4. The infrastructure of claim 2 wherein said driver chips are mounted in combination with said high temperature glaze by affixing said driver chips on the major surface of said high temperature glaze spaced apart from said common electrode layer.

5. The infrastructure of claim 1 further comprising at least one thermistor mounted in combination with said low temperature glaze.

6. The infrastructure of claim 1 further comprising a glaze layer laminated intermediate said substrate and said unitary common electrode layer, one edge of said glaze layer being coplanar with said edge surface of said substrate and said one edge of said common electrode layer.

7. The infrastructure of claim 1 wherein each said end faces have a predetermined width and each said conductive traces have a predetermined width, said predetermined width of each said end faces is greater than said predetermined width of each said conductive traces.

8. A true edge thermal printhead, comprising:

at least one infrastructure including a substrate member having first and second major surfaces and an edge surface, at least one of said first and second major surfaces having a substantially flat planar surface, a unitary common electrode layer formed from a refractory conductive material, having a melting temperature above approximately 1300° C., laminated on said flat planar surface and having multiple group taps extending therefrom, one edge of said electrode layer being substantially coplanar with said edge surface of said substrate member, a high temperature glaze laminated at approximately 1200–1300° C. on top of said common electrode layer and formed to have a predetermined thickness, one edge of said high temperature glaze being substantially coplanar with said one edge of said electrode layer, an electrode pattern laminated on said high temperature glaze, said electrode pattern being formed of a conductive material comprising a metal having a melting point that exceeds a processing temperature of a subsequent laminated layer, and said electrode pattern being a fine image pattern formed by a thick film technique and including a plurality of end faces substantially coplanar with said one edge of said high temperature glaze and a plurality of conductive traces integrally connected to respective ones of said end faces and extending along said high temperature glaze away from said end faces and terminating in interface ends for electrical interconnection with driver chips, a low temperature glaze laminated on said electrode pattern and said high temperature glaze, at a firing temperature less than the melting point of said metal of said electrode pattern, wherein all of said electrode pattern except said interface ends of said conductive traces are buried in said infrastructure of said true edge thermal printhead, one edge of said low temperature glaze being substantially coplanar with said end faces of said electrode pattern, said one edge of said common electrode layer, said one edge of said high temperature glaze, said end faces of said electrode pattern and at least a portion of said one edge of said low temperature glaze defining a printing edge surface for said infrastructure, and a plurality of resistive heating elements disposed on said printing edge surface of said infrastructure and interfaced, respectively, with said plurality of end faces and said common electrode layer;

a plurality of driver chips mounted in combination with said infrastructure distal said end faces of said electrode pattern and electrically connected to respective ones of said interface ends of said plurality of conductive traces and said multiple ground taps; and first and second cooling support members mounted in combination, respectively, with said substrate and said low temperature glaze.

9. The true edge thermal printhead of claim 8 wherein said at least on infrastructure comprises at least two infrastructures lap and butt jointed together, and wherein said first and second cooling support members are mounted in combination, respectively, with each said substrate and each said low temperature glaze of said at least two infrastructures.

10. The true edge thermal printhead of claim 8 wherein said plurality of driver chips are mounted in combination with said high temperature glaze distal said end faces of said electrode pattern, said driver chips being electrically connected to respective ones of said interface ends of said plurality of conductive traces and to said multiple ground taps, and wherein said driver chips and said interface ends of said conductive traces are embedded within said infrastructure by a second or potting low temperature glaze.

11. The infrastructure of claim 10 wherein said high temperature glaze is formed to include a plurality of wells and wherein said plurality of driver chips are disposed in combination with said high temperature glaze by disposing said driver chips in respective ones of said plurality of wells.

12. The infrastructure of claim 10 wherein said driver chips are mounted in combination with said high temperature glaze by affixing said driver chips on the major surface of said high temperature glaze spaced apart from said common electrode layer.

13. The infrastructure of claim 8 further comprising at least one thermistor mounted in combination with said low temperature glaze.

14. A true edge thermal printhead, comprising:

at least one infrastructure including a substrate member having first and second major surfaces and an edge surface, said first and second major surfaces having a substantially flat planar surface, a unitary common electrode layer formed from a refractory conductive material, having a melting temperature above approximately 1300° C., laminated on each of said flat planar first and second major surfaces and having multiple ground taps extending therefrom, one edge of each said electrode layer being substantially coplanar with said edge surface of said substrate member, a high temperature glaze laminated at approximately 1200–1300° C. on top of each said common electrode layer and formed to have a predetermined thickness, one edge of each said high temperature glaze being substantially coplanar with said one edge of said electrode layer, an electrode pattern laminated on each said high temperature glaze, said electrode pattern being formed of a conductive material comprising a metal having a melting point that exceeds a processing temperature of a subsequent laminated layer, and said electrode pattern being a fine image pattern formed by a thick film technique and including a plurality of end faces substantially coplanar with each said one edge of said high temperature glaze and a plurality of conductive traces integrally connected to respective ones of said end faces and extending along said high temperature glaze away from said end faces and terminating in interface ends for electrical interconnection with driver chips;

a low temperature glaze laminated on each said electrode pattern and said high temperature glaze, at a firing temperature less than the melting point of said metal of said electrode pattern conductive material, wherein all of said electrode pattern except said interface ends of said conductive traces are buried in said infrastructure of said true edge thermal printhead, one edge of each said low temperature glaze being substantially coplanar with said end faces of said electrode pattern, said one edge of each said common electrode layer, said one edge of each said high temperature glaze, said end faces of each said electrode pattern and at least a portion of each said one edge of said low temperature glaze defining a printing edge surface for said infrastructure, and a plurality of resistive heating elements disposed on said printing edge surfaces of said infrastructure and interfaces, respectively, with said plurality of end faces and said common electrode layer;

a plurality of driver chips mounted in combination with said infrastructure distal said end faces of said electrode pattern and electrically connected to respective ones of said interface ends of said plurality of conductive traces and said multiple ground taps; and first and second cooling support members mounted in combination, respectively, with each said low temperature glaze.

15. The true edge thermal printhead of claim 14 wherein said at least one infrastructure comprises at least two infrastructures lap and butt jointed together, and wherein said first and second cooling support members are mounted in combination, respectively, with each said low temperature glaze of said at least two infrastructures.

16. The true edge thermal printhead of claim 14 wherein said plurality of driver chips are mounted in combination with each said high temperature glaze distal said end faces of said electrode pattern, said driver chips being electrically connected to respective ones of said interface ends of said plurality of conductive traces and to said multiple ground taps, and wherein said driver chips and said interface ends of said conductive traces are embedded within said infrastructure by each a second or potting low temperature glaze.

17. The infrastructure of claim 16 wherein each said high temperature glaze is formed to include a plurality of wells and wherein said plurality of driver chips are disposed in combination with each said high temperature glaze by disposing said driver chips in respective ones of said plurality of wells.

18. The infrastructure of claim 16 wherein said driver chips are mounted in combination with each said high temperature glaze by affixing said driver chips on the major surface of each said high temperature glaze spaced apart from said common electrode layer.

19. The infrastructure of claim 14 further comprising at least one thermistor mounted in combination with at least one of said low temperature glazes of said infrastructure.

* * * * *